US007766764B2

(12) United States Patent
Malhotra

(10) Patent No.: US 7,766,764 B2
(45) Date of Patent: Aug. 3, 2010

(54) METHOD FOR PRACTICING GOLF EMPLOYING AN APPARATUS WHICH ALLOWS A GOLFER TO SIMULATE THE ANGULAR STANCES FREQUENTLY FOUND DURING PLAY ON A COURSE

(75) Inventor: Kushal Kiran Malhotra, 14 Hamilton Pl., Lake Grove, NY (US) 11755

(73) Assignee: Kushal Kiran Malhotra, Lake Grove, NY (US)

( * ) Notice: Subject to any disclaimer, the term of this patent is extended or adjusted under 35 U.S.C. 154(b) by 0 days.

(21) Appl. No.: 11/986,664

(22) Filed: Nov. 26, 2007

(65) Prior Publication Data

US 2009/0137334 A1 May 28, 2009

(51) Int. Cl.
*A63B 69/36* (2006.01)

(52) U.S. Cl. ..... 473/279; 473/269

(58) Field of Classification Search ..... 473/160, 473/218, 219, 227, 231, 257–279
See application file for complete search history.

(56) References Cited

U.S. PATENT DOCUMENTS 6,514,152 B1 * 2/2003 Huang et al. ..... 473/279
6,964,615 B2 * 11/2005 Lee ..... 473/160
2001/0044344 A1 * 11/2001 Leonard et al. ..... 473/279

* cited by examiner

*Primary Examiner*—Nini Legesse
(74) *Attorney, Agent, or Firm*—Kushal Malhotra

(57) ABSTRACT

An efficient, low cost and versatile golf practice device, which stimulates the angular stances frequently found during play on a course. The practicing golfer stands on top of a turf practice platform. This platform sits flat on top a region comprising a plane. The plane cuts off a slice of the area of a sphere. The plane faces north towards the sky while the opposite side is comprised of a curved arc portion that faces south, towards the earth. The spherical slice, (containing the flat platform), fits as a male portion into and on top of a female inverted dome region. The female spherical slice itself encompasses a space less than a full hemisphere. The female spherical slice is set inside the top surface of a rectangular box of length and width proportions roughly similar to an average driving range mat. The golfer stands on the platform and is capable of simulating a plurality of hitting conditions using the simple process of manual adjustment.

2 Claims, 1 Drawing Sheet

METHOD FOR PRACTICING GOLF EMPLOYING AN APPARATUS WHICH ALLOWS A GOLFER TO SIMULATE THE ANGULAR STANCES FREQUENTLY FOUND DURING PLAY ON A COURSE

CROSS REFERENCE-RELATED APPLICATIONS

This application claims priority to and the benefit of U.S. Provisional Application No. 60/860,022, filed Nov. 20, 2006, incorporated herein be reference in its entirety.

FIELD OF THE INVENTION

The present invention relates to a golf practice device. Specifically, the present invention relates to an efficient, low cost to build and versatile golf practice device. The practicing golfer stands on top of a practice platform. This platform sits flat on top a region comprising a plane. The plane is a slice of the area of a sphere, which it cuts off. The plane faces north towards the sky while the opposite curved arc portion faces south, towards the earth. The sphere fits as a male portion into a female inverted dome region, which itself encompasses a space less than a full hemisphere. The golfer stands on the platform and is capable of capable of simulating a plurality of hitting conditions using the simple process of manual adjustment.

STATE OF THE ART

In the past and currently, golf driving ranges in the United States and around the world offer only one axis upon which the practicing golfer may stand and strike his or her ball. In other words a practicing golfer may only hit the ball from an angle that is flat, along a planar X-axis. Previously, inventors have devised devices whereby a practicing golfer may simulate the hilly angles that he or she must face during golf course play. However, no previously devised apparatus is able to accomplish simulation of non-level stances in a way that is as simple, efficient and innovative as the design described below.

For example, U.S. Published Nos. 20020187848, 20020128084, 20020119827, 20010044344, 20010034272, U.S. Pat. Nos. 6,921,342, 6,514,152, 6,450,895, 5,944,615, 5,720,670, 5,558,334, 5,527,042, 5,470,074, 5,358,251, 5,340,111, 5,046,741, 5,005,837, 4,875,684, 4,331,332, 4,279,420, 3,693,979, 3,639,923, 3,633,918, 3,633,917, 3,430,964 and 2,937,875 are all related to improving golfer's skill in hitting ball on surfaces of various inclinations.

However, many of the above inventions employ electrical-mechanical and/or electrical-hydraulic platform mechanisms, which are complicated and expensive to design, manufacture, sell and maintain. U.S. Pat. Nos. 3,633,917, 5,340,111 and 5,358,251 to name a few, use hydraulic cylinders together with other highly customized parts to achieve the function.

Indeed, some the inventions do not employ electrical-mechanical and/or electrical-hydraulic platform mechanisms. These however, often display an array of complex mechanisms as well as multiple mechanical parts that combine to diminish the efficient manufacture, sale, installation and/or use of the end product. For instance the following inventions do not require external power sources to operate: U.S. Pat. Nos. 5,005,837, 5,046,741, 5,527,042, 6,514,152 and Pub. Nos. 20010044344, 20020187848. Nonetheless, the level of customization for the components used in these designs is too high to be cost effective U.S. Pat. No. 20010044344 employs a socket-ball combination along with movable supports. However the present claimed invention employs a ball and socket mechanism in a way much different that the aforementioned ball/socket design. 20010,044344 employ a design in which the ball portion emanates north away from the ground and fits into the platform accordingly. The present claimed invention has employs quite literally the opposite design feature. The female socket emanates north away from the ground and the male "ball" is in reality only and slice of a globe ball amounting to less than one hemisphere. On top of the hemisphere is a hard flat surface with turf placed on top.

Still, further designs are highly cost effective, are easy to manufacture and operate and have very few gadgets, components are moving parts. However, these designs have limited incline ranges and thus display drawback in versatility and therefore do not ideally simulate the range of angles found during play on a golf course. For instance, invention 20070078020 discloses and multi-angle golf swing practice platform wherein the device operates by changing the orientation of the platform rather its angle of inclination. In other words the device is simply a wedge shaped deck, which is rotated at 360° in any planar direction. Thus 2007007020 are extremely easy and cheap to use, operate and manufacture but it limits the user's ability to simulate the subtle angular stances regularly found on a golf course.

There is therefore a need in the industry to have an non-electrically or hydraulically powered apparatus which simulates the angular stances frequently encountered on a golf course, which is easy to use, cost effective, efficient and thorough in its ability to provide the user with all imaginable angles found during play.

SUMMARY OF THE INVENTION

The present invention is a golf swing-training platform for use at golf driving ranges as well as backyards in which a modified ball-socket mechanism allows a practicing golfer manually to adjust the stance from which the ball is struck with ease and efficiency. As a consequence the practicing golfer can simulate the non-level stances found on a course during actual play. The result of such practice gives the golfer who the present apparatus a significant competitive advantage of his or her peers when facing inevitable non-level stances during actual play on a course.

The apparatus employs not levers, hinges, wedges, pipes, hydraulics, electrical power sources or the like. Instead it operates via simple ball and socket mechanics wherein a male hemisphere slice is placed down upon a female hemisphere slice, which rests on the ground or similar flat surface. On top of the male hemisphere slice is a flat plane in which a platform is placed. The platform is outfitted with a removable turf mat. The practicing golfer stands on this turf mat platform and is able to practice golf shots struck from varying above and below the linear X-axis. Adjustment is done simply by mean of stepping off of the platform and manually adjusting the angle of the platform. The platform then stabilizes from the weight of the golfer who stands on it.

BRIEF DESCRIPTION OF THE DRAWINGS

FIG. 1A shows the front view of the apparatus. Female Object 1, 101 represents a rectangular box within which a hollow inverted spherical slice sits on the topside of the object. Male Object 2, 102 represents an outward and downwardly protruding spherical slice, which fits snuggly within the confines of the inverted spherical slice of Object 1, 101.

Figure 2:
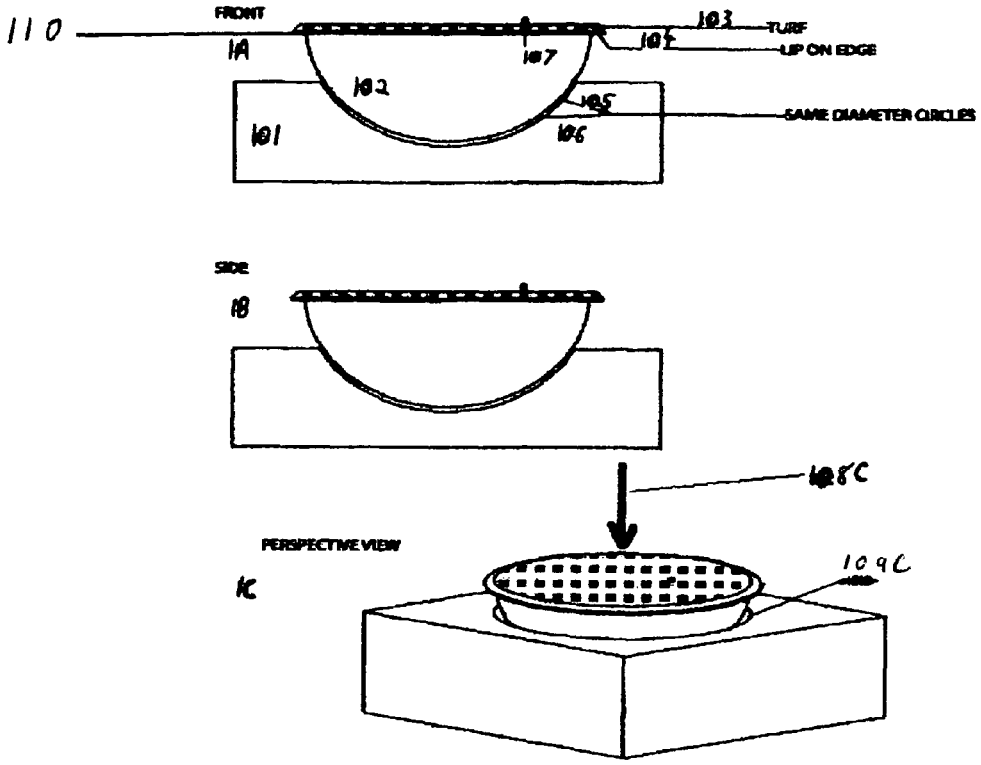

Turf 103 sits on top of a platform 110, which is placed over the planar top end of Object 2, 102. Protruding laterally from the platform 110 and platform turf 103 is a lip 104, which represents a stopper from which the maximum angle of adjustment is achieved only when the lip touches the top edge of Object 1, 101. The length of the cord, which represents the diameter of the spherical slice 106 of Object 1, 101, is ever so slightly larger than the outer diameter of the cord, which represents the spherical slice 105 of Object 2, 102. The marriage of Female Object 1, 101 and Male Object 2, 102 results in an induced fit at positions 105 and 106, which further results in a stable apparatus when a practicing golfer stands on top of Object 2, 102 (represented by the downward arrow 108C). Once off of the apparatus, the golfer may easily manually adjust the apparatus at any angle. The golfer may tilt Object 2, 102 forward, backward or diagonal at any plane of axis within the ranges bracketed by bracketed by Lip 104. The area encompassed between the lip 104 and the topside of rectangular box Object 1, 101 represent the range of angles 109C. Further note the modified (short) tee 107, which rests within turf 103.

Side view is represented by FIG. 1B.

Perspective three-dimensional view is represented by FIG. 1C.

DETAILED DESCRIPTION OF THE INVENTION

The detailed description of exemplary embodiments of the invention herein makes reference to the accompanying drawings and pictures, which show the exemplary embodiment reference to the accompanying drawings, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for the purposes of illustration only and not of limitation. For example, the steps recited in any of the method or process descriptions may be executed in any order and are not limited to the order presented.

The present invention is an apparatus that better simulates golf course play by providing varying degrees of stances from which a golfer may choose before striking his or her ball. Most golfers practice striking golf balls on a driving range. A driving range is a facility found by the tens of thousands, scattered throughout the United States of America and worldwide. Because driving ranges require less space and money than their golf course counterparts, driving ranges have also become a popular and more convenient alternative to playing golf on a course. Because golf is a highly skill and technique oriented game, beginning golfers often go to ranges exclusively and for long periods of time before even stepping foot on an actual golf course for an eighteen hole round. Additionally, golfers of all abilities use ranges to practice their technique and groove their swing for the purposes of improving their game when they play actual golf on a course.

However, driving ranges are ill equipped for simulation of the treacherous, non-level stances found on golf courses. Driving ranges would be a perfect place to practice golf if golf courses were as flat as a football field. Any golfer will attest to the fact that golf courses present inevitable non-level stances from which a golfer must effectively and accurately strike a ball in order to shoot a good score. Golf courses are rife with hills, noles, depressions, elevations, crowns, valleys and the like. Golfers often face stances on a course exceeding fifteen degrees past flat. They face stances where (a) their feet are below the ball or (b) above the ball. They face stances where (c) they must hit off of the face of a hill on the incline or (d) the decline. Combining (a) and (c), (a) and (d), (b) and (c), and (b) and (d) at any angle, less than twenty degrees past flat, creates an infinite amount of possible stances a golfer may face during his round. Examples of such stances would be a stance downhill and to the right, downhill and to the left, uphill and to the right and uphill and to the left. Driving ranges currently offer a grand total of one possible stance—flat and planar, parallel to the X-axis. One is only guaranteed to receive a flat stance on the golfing tee box. In an eighteen hole round, this will account for eighteen strokes out of the seventy to one hundred to two hundred strokes that golfers of varying abilities may take to complete a round of golf. Needless to say, a flat planar, parallel to the X-axis stance is available to the golfer on a course significantly less than one fourth of the time.

The apparatus comprises two independent objects, Object 1, 101 and Object 2. Object 2, 102 rests on top of Object 1, 101. Object 1, 101, as shown in the enclosed computer generated diagram, is a rectangular cube. The rectangular cube is placed flat on the surface of the earth, where the length and width dimension run along side the surface of the ground. The height dimensions of the rectangular cube are significantly less than both the length and width dimensions. The length and width dimensions are equal in scale and cover the approximate surface area of a driving range mat.

The topside of the surface of the structure has a large inverted space 106. The empty inverted space on the top surface of the rectangular box simulates that of a ball and socket design found in our human bodies both in the shoulder girdle (where the humorous attaches to the shoulder) and the pelvic girdle (where the femur attaches to the pelvis). Please see attached drawings for further illumination.

Note that this inverted space 106 shall be significantly less than the space created by an inverted hemisphere. However, the space shall be in perfect conformity with the dimensions of an inverted hemisphere, only the hemisphere shall be sliced so that the cross section of the hemisphere is cut far below the line of the equator. The reason for this design is to provide a stabile yet movable space for Object 2 102 to rest upon. Note that in the prototype the maximum angle that the device is capable of being tipped, in any direction above or below the planar x-axis, is 15°.

Object 2 102 contains a partial hemisphere where the cross section is cut far below the equator 105. This hemisphere fits perfectly within the inverted space 106 of the top surface of Object 1 101. The outer space of object two shall be the exact same spherical dimensions as the outer space of object one, thus creating a perfect socket-partial hemisphere fit. As shown in the enclosed figures, Object 2's 102 outer diameter turf 103 facing up fits within the dimensions of the square created by the length and width surface area of Object 1 101. Also note that the cross section of the hemisphere of Object 2 102 has a larger diameter at its widest point than the diameter of the cross section of the hemisphere of Object 1 101, at its widest point. In other words, Object 2's 102 dimensions are closer to a full hemisphere 105 than the inverted space of Object 1 101. This allows Object 2 102 to rest upon Object 1 101 in such a way that Object 2 102 rises above the space of created by the inverted space on the surface of Object 1 101.

The flat surface created by the cross section of Object 2 102 is the area upon which the golfer shall stand. It is flat and covered by the standard turf of a driving range mat. It shall be constructed of a solid substance (wood, plastic, metal, etc.) with the ability to support the weight of at least one fullgrown man 108C. Yet the machine will stay stable even with the much lighter weights of a small boy or girl golfers respectively.

The rounded surfaces of both Object 1 101 (i.e. the upper exposed inverted partial hemisphere) and Object 2 102 (the lower exposed partial hemisphere bulb) shall be covered in a rubber capable of being stabilized when a man, woman or child steps on top surface turf 103 of Object 2 102. That is to say that the two objects shall be stabile at any angle, within the given range, that the golfer chooses to practice his or her shot. The apparatus is, however, easily capable of being adjusted once the golfer steps off of the top surface turf 102 of Object 2 102.

The turf on the top surface turf 103 of Object 2 102 shall provide enough friction to stabilize a golf ball from falling off of the apparatus when the golfer for the invention's intended use tilts the apparatus. Note that in certain instances when the apparatus is tilted to a degree, which would otherwise cause the ball to roll away, the turf in and of it may be unable to provide the friction necessary to stabilize the ball. In these instances a modified rubber tee 107 will be installed into the top surface turf 103 of Object 2 102. Such a tee is commonly found on the standardized golf mats found the golf mats currently in use. However, this tee will be modified for the following reason: The tee box where a golfer "tees up" a golf ball for his first shot on a respective hole on a golf course is always flat. Thus the need to "tee up" a golf ball for the purposes of practicing golf shots from angled stances is unnecessary. The purpose of the tee in this invention would not be to simulate "teeing up" a golf ball but rather to simply ensure the stability of the ball on an angled surface. The tee would therefore be very short in height, (much shorter than the height of a normal rubberized tee used to "tee up" a ball to simulate hitting off of the tee box). The elevation of the tee would be very slight off of the top surface turf 103 of Object 2 102 so as to simulate hitting the ball off of the ground.

With respect to the present invention's surfaces in which Object 1 101 and Object 2 102 marry, the relevant friction constant shall be of utmost importance. While the substances to be used on the surfaces of the present invention have not been specified, the substances shall create a stable apparatus for the golfer to use while swinging the golf club. This is an important factor in the function of the invention because the force applied downward by the body weight of a golfer shall fuel the physics that account for the stability of the apparatus.

For the sake of brevity, specific friction constant factors, weight, mass, force, and acceleration numbers will not be used to further enlighten one skilled in the art to make and use the invention. These numbers will be handled in the Utility application, which will claim the benefit of this provisional application at a later date within one year of the date of filing of this provisional application.

By way of introduction however, the following description of the general application of the phenomenon of friction are described below:

Friction is the resistance to the relative motion of materials in contact with each other. While we often think of friction in a negative sense, and many physics problems ignore friction or assume that it is negligible, the fact is that without friction, we would have great difficulty getting anywhere! Certainly anyone who has fallen on a slippery surface or had difficulty getting up an ice-covered hill in a car can attest to the importance of friction.

Friction between surfaces results from microscopic irregularities, and ultimately involves electrical interactions on the atomic and molecular level. While the details of friction are quite complex (the study of friction is formally called tribology), the macroscopic properties can be examined and explained in rather simple terms.

In any case, the element of friction is critical for the proper functioning of the present invention. This is because, differing levels of friction will be the reason that a golfer may stand on the surface of object 2 in a tilted fashion with the apparatus remaining stabile throughout the practice stroke so long as the golfer is standing on the surface. The weight of the golfer 108C provides the downward force necessary to stabilize the spherical slice 105 treated (i.e. rubberized, sanded metal sprayed, etc) surface of Object 2 102 on top of the top inverted hollow female spherical slice 106 surface of Object 1 101. Note the surfaces 105 and 106 may respectively or both be treated by paint spray, sand treatment, metal spray, rubber application in any combination known to one skilled in the art.

When the golfer steps off of the apparatus, Object 2 102 can be shifted relatively easily to another position based on the personal fancy of the practicing golfer. Without the threshold downward force caused by the weight of the golfer on the top turf 103 of Object 2 102, the force created by Object 2's 102 own weight resting on top of Object 1 101 is sufficiently small enough for a golfer to shift the positioning of Object 2 102 in any desired tilted fashion bound by the Lip 104 which represents the maximum angle stopper (i.e. when Lip 104 touches the top surface of rectangular Object 1 101.

Although the specific dimensions of the apparatus are open to manipulation, the entire outer dimensions of Object 1 101 shall be sufficiently small enough to fit neatly in the average stall of a driving range practice booth (approximately 7 feet by 7 feet to 10 feet by ten feet). The dimensions of Object 2's 102 top surface turf 103 shall be sufficiently large enough to provide ample space for a practicing golfer to stand and strike a golf ball in a fashion similar to that experienced on the golf course itself.

The flat surface turf 103 on top of Object 2 102, which is outfitted with a replaceable mat of artificial turf, has a lip 104 around all sides of its edge. This flip juts out over the edge of the inverted hemisphere in which it rests. The lip 104 provides a stopper mechanism, which controls the maximum angle that Object 2 102 may be tilted. This provides for the increased safety and stability of the practicing golfer using the apparatus.

While present invention has been shown, described and illustrated in detail for illustrative purpose, it should be understood by those skilled in the art that equivalent changes in form and detail may be made therein without departing from the true spirit and scope of the invention as disclosed in the accompanying claims.

The invention claimed is:

1. A method of striking a golf ball comprising the method steps of:

(a) providing an adjustable golf practice apparatus consisting of a male spherical slice and a female spherical slice; wherein the male spherical slice has a top circular flat plane in which a platform is fitted with a removable turf mat; wherein the male spherical slice has a bottom spherical body that is coated alone or by a combination of rubber, sand, metal, paint, or polymer; wherein a lip protrudes laterally from the platform;

wherein the female spherical slice is rectangular in shape and has a flat bottom surface that rests on a ground; wherein the female slice has a top surface that has a flat top portion with an inverted spherical portion at a center location; wherein the inverted space of the female spherical slice is coated by alone or by combination of rubber, sand, metal, paint, or polymer; wherein the bottom of the male spherical slice fits snuggly into the inverted space of the female spherical slice; wherein a gap is provided between the top plane of the male slice and the top flat surface of the female slice when the platform and the bottom surface of the female slice are in parallel position; wherein the gap allows angular adjustment between the male and the female slices;

(b) allowing a golfer to stand on top of the adjustable device and practice any angular stances that are frequently used in a golf game;

(c) maintaining readjustment of the angular stance positions by allowing the golfer to step off the apparatus and manually adjust the angle of the platform in relation to the top flat surface of the female slice to choose one angular stance from an array of possible angular stances at any direction within a maximum range of 20 degrees;

wherein the apparatus will not allow the golfer to exceed the maximum angle since any manual adjustment of the platform is curtailed when said lip contacts the upper flat surface of the female slice;

(d) providing easy manual adjustment of the male slice when the golfer is off the training apparatus rather than when the golfer is on top the device; and (e) providing a tight fit of the male slice into the female slice by increasing friction between the slices when the golfer stands on the platform such that the platform is stable and non movable in the adjusted angular stance.

2. An adjustable golf practice apparatus consisting of a male spherical slice and a female spherical slice; wherein the male spherical slice has a top circular flat plane in which a platform is fitted with a removable turf mat; wherein the male spherical slice has a bottom spherical body that is coated alone or by a combination of rubber, sand, metal, paint, or polymer; wherein a lip protrudes laterally from the platform; wherein the female spherical slice is rectangular in shape and has a flat bottom surface that rests on a ground; wherein the female slice has a top surface that has a flat top portion with an inverted spherical portion at a center location; wherein the inverted space of the female spherical slice is coated by alone or by combination of rubber, sand, metal, paint, or polymer; wherein the bottom of the male spherical slice fits snuggly into the inverted space of the female spherical slice; wherein a gap is provided between the top plane of the male slice and the top flat surface of the female slice when the platform and the bottom surface of the female slice are in parallel position; wherein the gap allows angular adjustment between the male and the female slices;

wherein a golfer is capable of readjusting the angle of the platform in relation to the female flat by stepping off the apparatus and manually adjusting the platform to an angular stance at any direction within a maximum range of 20 degrees; wherein the apparatus will not allow the golfer to exceed the maximum angle since any manual adjustment of the platform is curtailed when said lip contacts the upper flat surface of the female slice; wherein easy manual adjustment of the male slice provided when the golfer is off the training apparatus rather than when the golfer is on top the device; and a tight fit of the male slice into the female slice by increasing friction between the slices is maintained when the golfer stands on the platform providing the platform a stable and non movable position.

* * * * *